United States Patent [19]

Belbel et al.

[11] Patent Number: 4,536,630

[45] Date of Patent: Aug. 20, 1985

[54] LIMITING SWITCH

[75] Inventors: Elie Belbel, Epinay; Christian Blanchard, Nanterre; Louis Fechant, Le Vesinet; André Haury, Le Raincy; Michel Lauraire, Courbevoie, all of France

[73] Assignee: La Telemecanique Electrique, Nanterre, France

[21] Appl. No.: 576,847

[22] Filed: Feb. 3, 1984

[30] Foreign Application Priority Data

Feb. 4, 1983 [FR] France ..... 83 01750

[51] Int. Cl.[3] ..... H01H 33/06

[52] U.S. Cl. ..... 200/151

[58] Field of Search ..... 200/151

[56] References Cited

U.S. PATENT DOCUMENTS 3,281,561 10/1966 Marx et al. ..... 200/151
4,467,298 8/1984 Belbel et al. ..... 200/151

FOREIGN PATENT DOCUMENTS 591598 1/1934 Fed. Rep. of Germany ..... 200/151
921512 12/1954 Fed. Rep. of Germany ..... 200/151
1010618 7/1957 Fed. Rep. of Germany ..... 200/151

*Primary Examiner*—Robert S. Macon
*Attorney, Agent, or Firm*—William A. Drucker

[57] ABSTRACT

A current limiting switch is provided comprising two mobile levers subjected to the action of springs which apply, one against the other, separable contact pieces placed at the respective ends thereof; a thin electrically insulating screen placed between the levers so that its edge is inserted between the contact pieces while maintaining complete insulation between the levers when these latter move away from each other, following short circuit currents flowing in the switch, wherein the ends of the levers, where the contact pieces are placed, are situated in the immediate vicinity of an insulating surface of the case, so that the path of the arc is essentially tangential with respect to the movement of the mobile contacts, the movement of said edge towards and against said insulating surface causing constriction of the arc and completely insulating from one another the two opposite and sealed chambers which the screen separates within the internal volume of the case.

10 Claims, 13 Drawing Figures

LIMITING SWITCH

BACKGROUND OF THE INVENTION

1. Field of the Invention

The invention relates to limiting switches comprising, in a case: at least one mobile lever subjected to the action of a resilient member which applies one against the other contact pieces placed at the respective ends of the lever arm carrying the mobile contact and of a contact support substantially parallel to said arm; a thin insulating screen placed between said lever arm and the support so that its edge is inserted between the contact pieces, while maintaining the insulation between the lever and the support when these latter move away from each other following short circuit currents flowing in the switch.

2. Description of the Prior Art

Such switches, which are advantageously used for protecting more especially electricity consuming appliances of every kind, for example in conjunction with circuit breakers, may be illustrated by the French Patent Application No. 81 15573 filed on the 07.08 81 by the applicant for: "An automatic short circuit current limiting device". In the switch forming the subject of said application, measures are taken so that the arc appearing between the contact pieces situated in the vicinity of the ends or horns of two levers which form the supports for the contacts when these latter move away from each other under the effect of the electrodynamic forces which appear therebetween, is drawn out radially with respect to the axes of said levers, not only by the effect of the current loop formed by this arc, but also by the rapid movement of the edge of the screen, which extends the arc so as to lead it into a region between two extinction chambers provided with fractionizing fins in which this arc will be extinguished.

A study of the performance of a known switch of this type, namely: its low cut off time, the peak current which it limits to reduced values and the low energy dissipated, has shown that the technique used was particularly advantageous in a range of short circuit currents of intensities between low and medium values for, under these conditions the effects of lengthening and cooling the arc caused by the screen are preponderant. On the other hand, if it is desired to keep these performances in the range of higher intensities, with the known technique, it has been discovered that the speed of separation of the contacts and the natural swelling of the arc caused by the electrodynamic forces are such that the screen has not time to produce the desired effects; it has more especially been discovered, when the break is operated at these high intensity values, that relatively high arc energy is released at the time of breaking.

SUMMARY OF THE INVENTION

The invention provides then, in an extremely simple way, an improved current limiting switch whose general construction corresponds to that mentioned above, in which the energy dissipated during breaking of a short circuit current of low to high intensity is reduced and the structure of the extinction chambers is simplified so as to substantially reduce the volume of the apparatus.

According to the invention, this is achieved because the ends of the supports where the contact pieces are placed, move with respect to each other in the immediate vicinity of an insulating surface of the case, preferably substantially perpendicular to the plane of movement of the levers, so that the path of the arc is essentially tangential, the movement of the edge towards and against this insulating surface causing first of all shearing of the arc and then complete and sealed electric insulation between the two opposite chambers which the screen separates inside the internal volume of the case. A switch is already known from German Pat. No. 1010618 and from French Pat. No. 1238660, in which an insulating screen is inserted between two contact pieces each carried by a lever, and in which one edge of this screen cooperates with an insulating surface for effecting flattening of the arc. However, complete shearing of the arc is neither obtained, nor desired, the desired effect being an extension or lengthening of the arc principally in a radial direction, which effect cannot cause the arc voltage to increase sufficiently rapidly. No provision is made for establishing complete insulation of the upstream and downstream volumes in which the respective levers are placed, so that striking of a parasite arc may be feared when the switch opens at the moment when a short circuit current is flowing therethrough. Moreover, opening of this switch is caused by a mechanical action of the screen on the levers and does not result from these latter moving apart following the appearance of short circuit currents: rapid metalization of the screen by rubbing on a molten metal, so loss of insulation, may result therefrom.

BRIEF DESCRIPTION OF THE DRAWINGS

Other features and advantages of the invention will appear clearly from the following description.

In the accompanying drawings.

DESCRIPTION OF THE PREFERRED EMBODIMENTS

Figure 1:
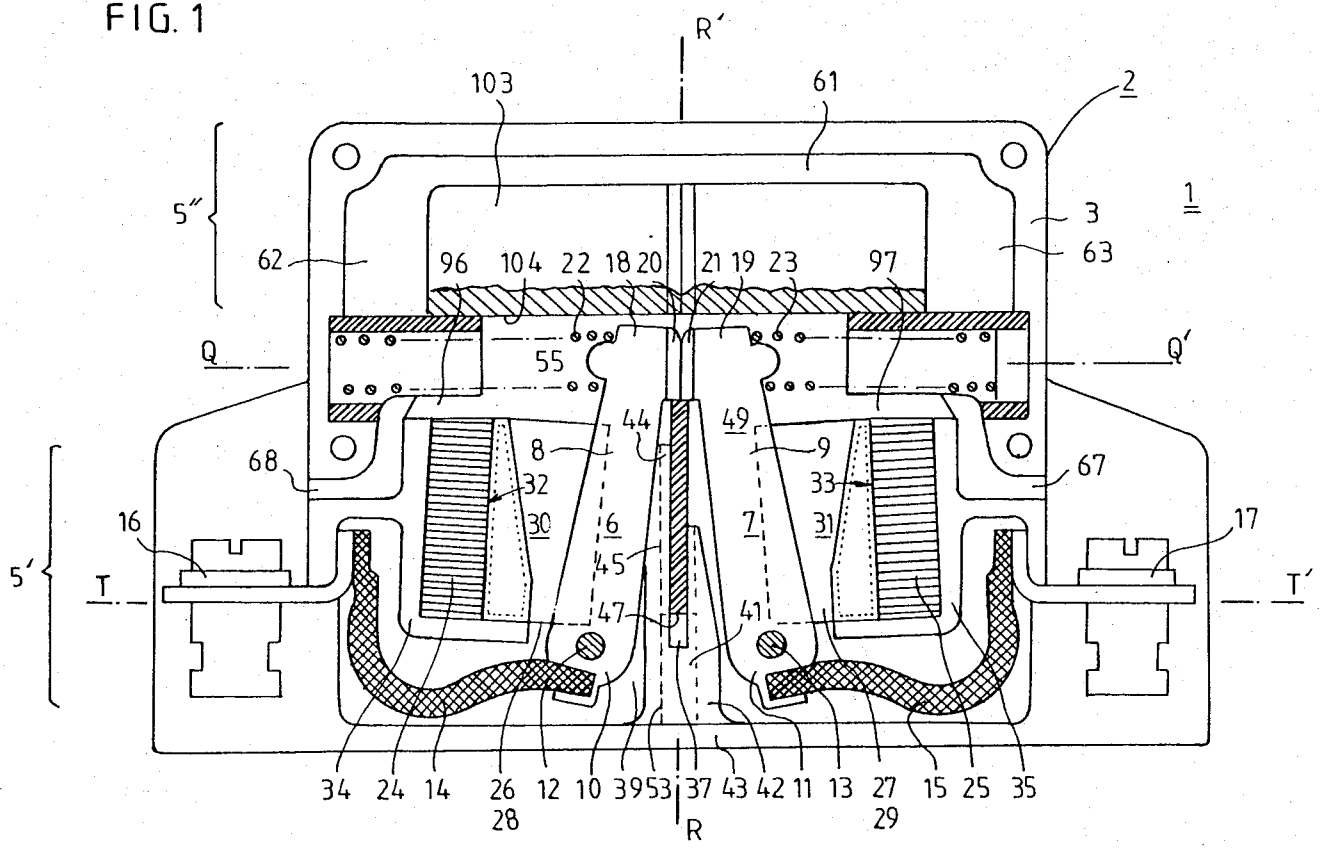
FIG. 1 shows a limiting switch according to a preferred embodiment of the invention, seen in section through the plane PP' which contains the two contact levers.

The current limiting switch 1 (FIG. 1) comprises an insulating case 2 formed for example by associating two symmetrical cases 3, 4 together along a joining plane PP' which is that of the Figure.

A first internal region 5' of the case, placed below a plane QQ' defined further on, contains two contact levers 6 and 7, whose arms 8 and 9 are roughly parallel to each other and whose lower ends 10, 11 are mounted for pivoting about two respective parallel axes 12, 13. These lower ends are connected by braided conductor wires 14, 15 to connecting terminals 16, 17 placed at the end of the case for providing connections, on the one hand with a power supply line and, on the other, with a load, possibly with a protecting apparatus such as a circuit breaker placed therebetween. The upper ends 18, 19 of the levers are equipped with contact pieces 20, 21; these latter are placed directly at these ends, which do not then have any arc extensions or horns such as may be met with in certain circuit breaking apparatus having similar applications.

Two contact pressure springs 22, 23, for example helical, exert antagonistic forces on the contact levers, so as to apply the contact pieces against each other with a suitable force. This force must be sufficient for maintaining between the contacts a pressure such as to remove any risk of welding when currents of the order of 10 to 15 times the nominal current of the switch cause electrodynamic forces between the arms of the levers in the opposite direction to those of the springs. Advantageously, these springs exert their actions in the plane QQ', which passes substantially through the contact pieces.

Between the springs and the pivots are placed laminated magnetizable pieces 24, 25 in the shape of a U, at the entrance of the legs 27, 29 and 26, 28 of which the arms of the levers are placed in the rest position.

Between these legs are to be found grooves 30, 31 in which the arms of the levers may move angularly in the directions of the bottoms 32, 33 of the U shaped pieces. Material contours such as 34, 35, belonging to the two half cases, provide a stable position for these magnetic pieces.

Figure 2:
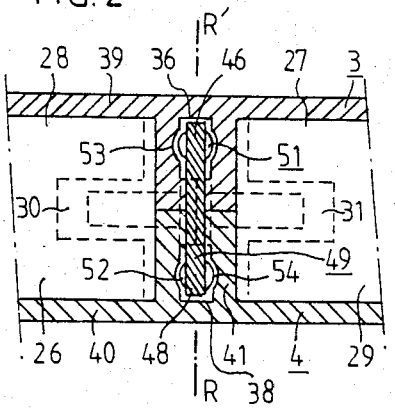
FIG. 2 is a partial top view of this switch in section through plane TT' of FIG. 1.

In a plane RR' perpendicular to PP' and passing substantially symmetrically between the levers, is disposed a system of guide grooves 36, 37, 38 (see also FIG. 2) whose path passes through the parallel opposite walls 39, 40 of the case and through a dividing wall 41 perpendicular to the plane of the Figure; this dividing wall, whose base 42 is joined to the bottom 43 of the case, rises to an upper edge 44 placed between the pivots 12, 13 and the contact pieces 20, 21. A lateral face 45 of this dividing wall, possibly higher than the other one, may serve as a bearing surface for one of the levers, for example a lever 6, so as to give it a well defined position in cooperation with a compression of spring 22 slightly greater than that of the other spring 23. In the plane RR' is placed a thin insulating screen 49 whose edges 46, 47, 48 are engaged with a slight play in the guide grooves 36, 37, 38 (see also FIG. 2).

Figure 3:
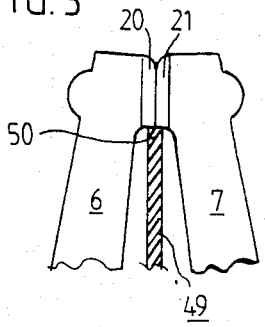
FIG. 3 shows, in elevation, a detail of FIG. 1, located in the contact zone of the switch.
Figure 4:
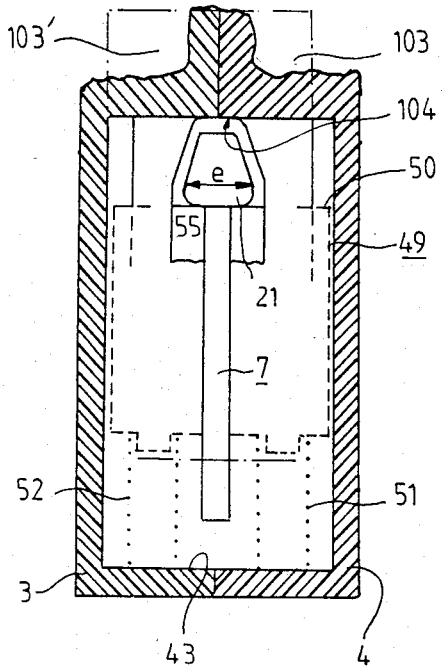
FIG. 4 shows, in a side view and in partial section, a detail of construction of FIG. 1, located in a region in which move a mobile contact and the screen.

In the rest position of the switch, shown in FIG. 1 and in FIG. 3, an upper edge 50 of the screen, substantially perpendicular to the plane PP', is applied to the edge of at least one of the contact pieces by compression springs 51, 52 placed in housings 53, 54 opening opposite the lower edge 47 of the screen (see also FIG. 2); these springs 51, 52 bear, in a direction opposite edge 50, on a neighbouring face of the bottom 43 of the case or on this latter (see FIG. 4).

Each half case comprises in a region 5'', placed above the plane QQ', an insulating transverse wall 103, 103' which extends substantially parallel to plane QQ' and has a surface 104 directed towards the end of the two levers; these two walls are applied one against the other along plane PP'' when the half cases 3, 4 are assembled together.

Surface 104 is placed in the immediate vicinity of the ends 18, 19 with sufficient play so as not to hinder movement thereof; it itself forms the bottom of a passage 55 whose width, measured parallel to the axis of the pivots of the levers, is slightly greater than the width "e" of the contact pieces (see FIG. 4).

Figure 5:
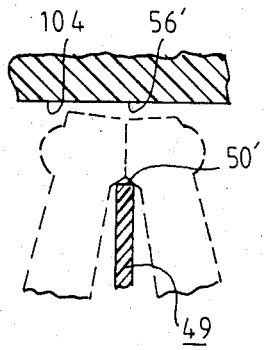
FIGS. 5*a*, 5*b*, 5*c* illustrate, in elevation, different embodiments of the surface of the case with which the upper end of the screen cooperates.

In a first embodiment of the invention, the region 56' of the surface 104 which is placed opposite the upper edge 50' of the screen is continuous; this region may be flat (See FIG. 5*a*), or have slight corrugations 56'' (see FIG. 5*b*), or else comprise prismatic grooves 56''' (see FIG. 5*c*). The profiles of the upper edges 50', 50'', 50''' have, in these cases, complementary shapes shown in these Figures.

Figure 6:
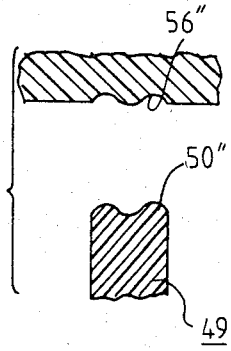
FIG. 6 shows, in elevation, another embodiment of the means receiving the end of the screen.

In a second embodiment, shown in FIG. 6, the surface 104 has, opposite the upper edge 50 of the screen, a slot or notch 57 to the bottom of which the screen may penetrate during opening of the switch. In this latter case, this groove 57 is advantageously connected either to channels 58, 59 which open in its sides, or to a channel 60 which opens into the extension of the groove, or to a multiplicity of channels of each of the two kinds. These channels communicate in their turn with a decompression circuit comprising channels 61, 62, 63 placed between walls 103, 39, 40 and lateral walls 64, 65, 66 of the case so as to open out into the atmosphere through two vents 67, 68 close to the terminals. These channel portions 61, 63 may advantageously pass round housings 69, 70 in which the contact pressure springs are guided.

When currents of a relatively high intensity flow through the switch, such as those which appear for example when the line supplies a motor having difficulty in starting or at the time of impeding short circuits, the electro dynamic forces which are developed between the arms of the levers are not sufficient to overcome the forces applied by the springs and the contacts remain closed.

When, on the other hand, currents of excessive intensity such as those which appear suddenly when full short circuits occur, flow in the contact levers, the electrodynamic forces developed between these levers produce repulsion forces such that these latter are moved away from each other. At the same time, attraction forces appear from the interaction between the currents flowing in each lever and fields are induced in the magnetic pieces 24, 25; these latter forces, which attract each lever in the slot 30, 31 of each magnetic piece, are added to the preceding ones to cause extremely rapid separation of the contact pieces.

As soon as the contact pieces 20, 21 move away from each other, the screen 49, which was retained by at least one of them, is propelled upwardly in the direction of circuits 104. The electric arc which strikes between the contact pieces at the moment of their separation develops tangentially between these contacts because of the proximity of surface 104 which prevents any radial movement. The very rapid movement of the upper edge 50 of the screen towards surface 104 against which it is applied produces, during this development, complete shearing of the section of the arc. Experiences show that there follows a suprising increase of the gradient of the arc voltage, so that this latter is extinguished very rapidly. This rapid extinction phenomenon of an arc by complete shearing of its section is explained more fully in the French patent application filed on the same day by the applicant for: "switch device having an insulating screen coming between the contacts during breaking and means for shearing the arc between this screen and an insulating wall".

The sealed separation or insulation which are partially formed between the upstream half and the downstream half of the switch, through baffles created by the guide grooves 36, 37, 38 are completed by the arrival of the screen against surface 104, which avoids restriking of the arc. This sealing is further improved by arrangements shown in FIGS. 5*a, b, c* or better still by the one shown in FIG. 6, where an additional baffle is formed at the level of the upper edge when the screen penetrates into groove 57.

Figure 8:
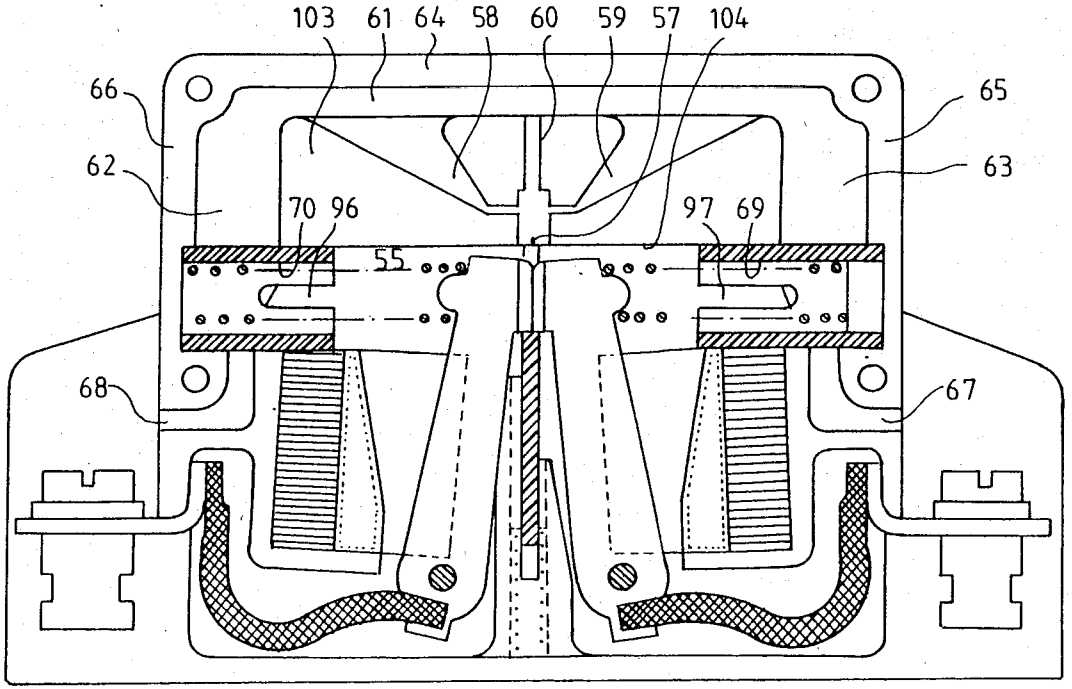

In FIG. 8 it can be seen that, after opening of the switch, the volume of this latter is divided into two completely sealed opposite chambers 100, 101.

It will be noted that the insulation is also provided in the lower region of the switch because, during movement of the screen, its edge 47 does not leave the groove 37 in which it is guided.

When the embodiment shown in one of FIGS. 5*a* to 5*c* is adopted, the gases which appear at the time of arcing may be removed along the passage 55, in the direction of vents 68, 67 and their pressure is balanced because of the presence of channels 61, 62, 63. When the embodiment shown in FIG. 6 is adopted, the gases may escape, not only through one of channels 58, 59, 60 and reach the vents through channels 61, 62,63 which pass round the housings 69, 70 for guiding the springs 22, 23 but also through indentations 96, 97 in insert sleeves 69, 70 containing the springs and connecting passage 55 to the vents 68, 67.

In the apparatus such as it is described, the speed of movement of the screen is sufficient to avoid a certain stagnation of the arc which might damage the contacts; it is however not such that the rise of the arc voltage is too sudden and causes the generation of shock waves likely to cause the case to explode. Because of the relatively high speed with which the screen is propelled towards surface 104, bouncing thereof may be feared, likely to cause restriking of the arc, because of the restablishment of the continuity of an ionized, so conducting, atmosphere.

Damping means adapted for preventing such bouncing and using friction for example, are therefore associated with the screen for preventing a backward movement thereof after impact.

Figure 7:
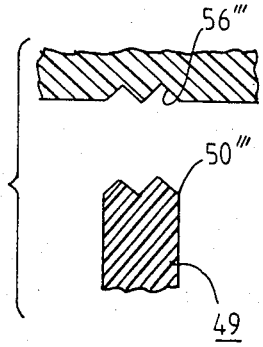
FIGS. 7, 8 and 10 show three embodiments of means for damping bouncing of the screen at the end of its travel, FIG. 10 being a partial side view in section through plane RR' and FIGS. 7 and 8 local sections through the plane PP'.

When the screen penetrates into a groove such as 57, these damping means may be placed inside this latter; in FIG. 7 it can be seen that the upper edge 71 of the screen 72 has a bevelled shape adapted for cooperation with a resilient leaf or layer 73 whose shape corresponds to that of the bevel and which is, if required, associated with lateral pressure means 74, 75.

When screen 49 comes directly into abutment against surface 104, the damping means may be disposed in the dividing wall 41 so as to prevent any possible backward movement of the screen (see FIG. 8); a resilient blade, wire or clip 76 is disposed at the bottom of groove 37 so as to have at least one end 77 moveable against a face 78 of screen 49 when this latter is in the rest position; and so as to maintain this screen in its upper working position by cooperation with its lower edge 47.

Figure 10:
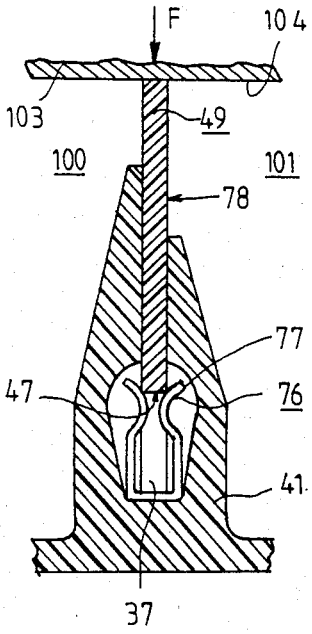
Figure 12:
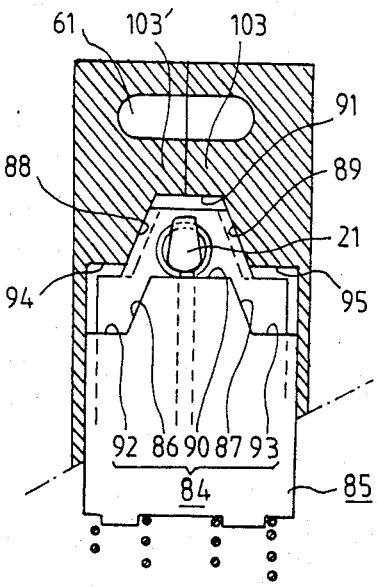
Figure 13:
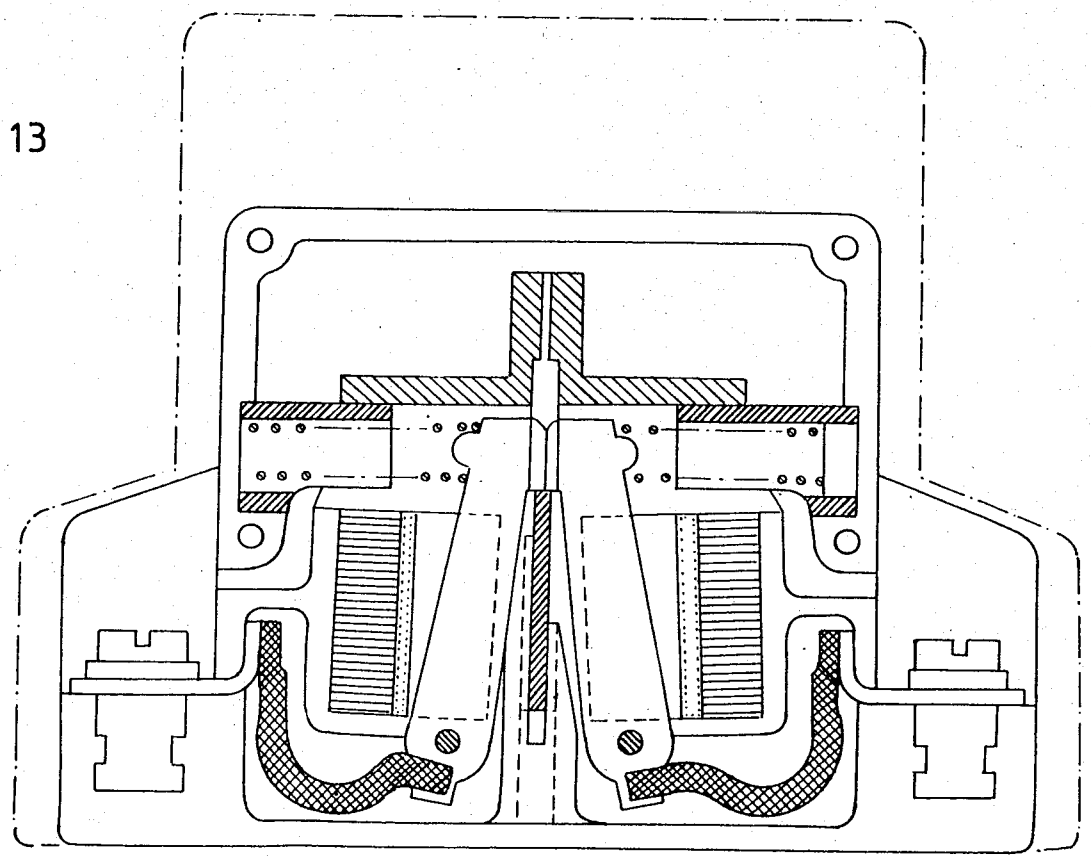

In another embodiment of the damping means (see FIG. 10), the upper edge 84 of screen 85 has in its plane the shape of a trapezium whose sloping sides 86, 87 are applied against two sloping lateral walls 88, 89 of a case, so as to cause a slight jamming effect which holds the screen in position and prevents bouncing thereof; the endmost part 90 and the lateral parts 92, 93 of this upper edge may advantageously be engaged in notches 91, 94, 95 for forming baffles for it is, in this case, difficult to manufacture two exactly identical profiles which are capable of producing complete insulation between the two parts of the switch; it goes without saying that baffles could also be disposed opposite the sloping sides, as is shown with broken lines in the Figure.

After automatic opening of the switch, the contacts may either come resiliently into abutment against the opposite faces of the screen, or be held away from this latter by securing means adapted to retain the contact levers, using for example springs passing through a neutral point, or hooked, not shown in the drawings.

Although manual or other means for resetting the switch and/or the screen after automatic opening have not been shown in detail, it will of course be readily understood that such means are associated with the case and with the screen for giving again to this latter, after automatic opening and disappearance of the fault which caused the opening, a rest position corresponding to the one shown in FIG. 1.

These means, which must naturally overcome the friction communicated to the screen by the damping means, exert on this screen a vertical action in the direction of arrow F, so as to bring the upper edge of the screen below the level of the contact pieces, which then take up again their original closed position (see for example FIG. 9).

Figure 9:
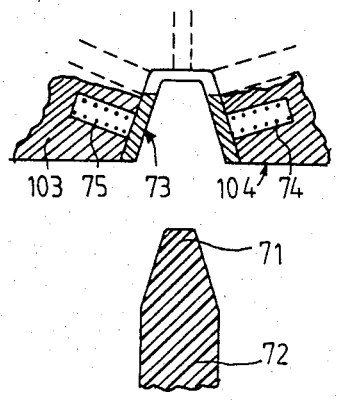
FIG. 9 shows, in a side view through the plane RR', one embodiment of the means for resetting the switch.

FIG. 9 shows schematically how, by means of a flat pusher 80 disposed for sliding in plane RR', it is possible to reset the screen 49 by exerting a vertical action in direction F on the upper edge 84; this pusher has the shape of a fork with two arms 81, 82 so as to free the contact region of the contact pieces.

Although the invention has been illustrated in connection with a preferred embodiment comprising two mobile contact levers, very good results can still be obtained when one of the contact levers is replaced by a fixed support roughly parallel to the mobile contact lever.

Comparative test results have shown that the automatic opening of the switch, when short circuit currents appear having an assumed level of 25kA under a three phase voltage of 420 volts, occurs with an arc energy three times less than that observed in present comparable current limiting apparatus.

Furthermore, tests carried out on switches in accordance with the invention for low current ratings, have shown that the short circuit current limitation was comparable to that obtained by means of fuses, even better.

Figure 11:
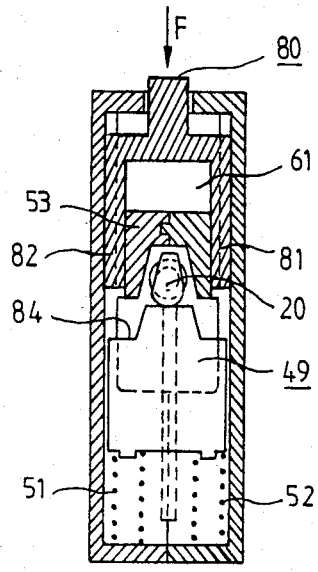
FIG. 11 illustrates the reduction in size which may be obtained, for an apparatus having the same rating, with the present invention.

From FIG. 11, where the broken lines show the dimensions of an apparatus in accordance with the Prior Art, can be seen the space saving obtained by putting into practise the measures of the invention, see the continuous lines.

What is claimed is:

1. In a current limiting switch comprising, in a case: at least one mobile lever subject to the action of a resilient member which applies one against the other separable contact pieces directly placed at the respective ends of the lever arm carrying the mobile contact and a contact support roughly parallel to said arm; a thin electrically insulating screen which is placed between the lever arm and the support so that its edge is inserted between the contact pieces, while maintaining the insulation between the lever and the support, when these latter move away from each other following short circuit currents flowing in the switch, the ends of said contact supports, where said contact pieces are located in the immediate vicinity of an insulating surface of the case, so that the path of the arc is essentially tangential with respect to the movement of the mobile contact, the movement of said edge towards and against this insulating surface causing first of all shearing of the arc and then establishing complete and sealed electric insulation between two opposite chambers which the screen separates within the internal volume of the case.

2. The current limiting switch as claimed in claim 1, wherein the conducting supports of said contacts are moved away from each other by an electrodynamic repulsion action which appears with a short circuit and the screen, normally retained upstream of the contacts, is propelled between said contact pieces as soon as these latter have begun to move away from each other.

3. The current limiting switch as claimed in claim 1, wherein said insulating surface is situated roughly in a plane substantially perpendicular to the one which contains the supports for the contacts.

4. The current limiting switch as claimed in claim 1, wherein the mobile contact or contacts move with a slight play in a tangential passage whose bottom is formed by said wall, whereas said screen is guided with a slight play in grooves formed in the faces of the case parallel to the plane of said contact supports.

5. The current limiting switch as claimed in claim 1 wherein said insulating surface has corrugations or prismatic grooves and the surface facing the edge of said screen has a complementary shape.

6. The current limiting switch as claimed in claims 1, wherein said insulating surface has a slot or notch to the bottom of which said edge of said screen penetrates, air evacuation channels ending in this groove or notch.

7. The current limiting switch as claimed in claim 1, wherein damping means are provided for preventing said screen from bouncing on said insulating surface.

8. The current limiting switch as claimed in claim 6, wherein said damping means comprise a bevelled shape given to the edge of said screen and an elastic layer of complementary shape lining said slot or notch.

9. The current limiting switch as claimed in claim 7, wherein said damping means comprise a resilient member cooperating with the edge of the screen opposite the one which comes into contact with said insulating surface.

10. The current limiting switch as claimed in claim 7, wherein said damping means comprise an arrangement of the edge of said screen and of the facing portion of said insulating surface such that a jamming effect is produced.

* * * * *